US008707828B2

(12) United States Patent
Ward

(10) Patent No.: US 8,707,828 B2
(45) Date of Patent: Apr. 29, 2014

(54) COMBINED CORKED BOTTLE OPENER AND FLUID AERATOR

(76) Inventor: William P Ward, Bay Village, OH (US)

( * ) Notice: Subject to any disclaimer, the term of this patent is extended or adjusted under 35 U.S.C. 154(b) by 255 days.

(21) Appl. No.: 13/289,584

(22) Filed: Nov. 4, 2011

(65) Prior Publication Data

US 2012/0111153 A1 May 10, 2012

Related U.S. Application Data

(60) Provisional application No. 61/410,935, filed on Nov. 7, 2010.

(51) Int. Cl.
*B67B 7/04* (2006.01)

(52) U.S. Cl.
USPC ..... 81/3.29

(58) Field of Classification Search
USPC ..... 81/3.2, 3.29, 3.45, 3.48; 7/155; 215/40; 99/323.1
See application file for complete search history.

(56) References Cited

U.S. PATENT DOCUMENTS

| | | | | |
|---|---|---|---|---|
| 4,276,789 | A | 7/1981 | Allen | |
| 4,703,673 | A | 11/1987 | Allen | |
| 5,595,104 | A | 1/1997 | Delaplaine | |
| 7,614,614 | B2 | 11/2009 | Sabadicci et al. | |
| 2010/0011967 | A1 | 1/2010 | Barberio | |
| 2010/0058933 | A1 | 3/2010 | Cheng | |
| 2012/0074092 | A1 * | 3/2012 | Devoy et al. | 215/40 |

* cited by examiner

*Primary Examiner* — David B Thomas

(57) ABSTRACT

An apparatus used for a corked bottle opening and fluid aeration device. It is comprised of a vertical holder with features to receive and guide the bottle and with features to permit and direct fluid flow for aeration; a cork-engaging member with a handle and corkscrew; a fluid receiving section; and a means for connecting the apparatus to the atmosphere. Preferably the features divide the sections by a stop, by a cone shape, and by a shoulder. The apparatus engages the corkscrew to the holder when used as a bottle opener and the apparatus restricts fluid flow enabling a venturi effect when used as an aerator. The apparatus allows a full hand grip on holder and bottle to ease removal of a cork from the bottle.

18 Claims, 15 Drawing Sheets

COMBINED CORKED BOTTLE OPENER AND FLUID AERATOR

CROSS REFERENCE TO RELATED APPLICATIONS

This application claims the benefit of Provisional Patent Application Ser. No. 61/410,935 filed on Nov. 7, 2010 by William Ward and entitled "Combination Bottle Opener and Fluid Aerator".

FIELD OF THE INVENTION

The present invention relates to an apparatus for bottle opening and fluid aeration, and more particularly, the present invention relates to an apparatus for opening corked bottles and wine aeration. A number of features are desired in such an apparatus. One of the most important of these is to open a corked bottle and then aerate fluids of said bottle with one apparatus. Another desired feature would be the ability to ergonomically grip the holder and bottle with a full hand when extracting the cork. Additionally, during cork extraction, the apparatus would not puncture the cork top to bottom allowing the cork to be reused to reseal the bottle. Further, the cork should be easily removed from the apparatus without having to hold the cork.

FEDERALY SPONSORED RESEARCH

None.

SEQUENCE LISTNING OR PROGRAM

None.

BACKGROUND

Field of Invention and Prior Art

Numerous Corked Bottle Openers and Fluid Aerators are known in the art, none of them combine a Cork Bottle opener and Fluid Aerator. Further, prior art has failed to produce a simple and relatively inexpensive device which incorporates all of the aforementioned features.

Several variations of corked bottle openers known in the art, such as, Wing Corkscrews, Rabbit Corkscrews, Fulcrum Corkscrews and Self-Pulling corkscrews, will not aerate fluids. Additionally, these corked bottle openers do not allow a full hand grip of the corked bottle opener with one hand while simultaneously having a full hand grip of the bottle with the other hand while removing the cork from a corked bottle. These types of corked bottle openers also fall short in other aspects. The wing type corked bottle openers require several moving parts and do not allow the user to hold the bottle while removing the cork., rabbit Corkscrew are costly due to there complex construction, fulcrum corkscrews are not easy to operate and requires a certain level of skill by the user, and Self-Pulling Corkscrews puncture corks top to bottom preventing reuse of the cork to reseal the bottle.

Venturi type devices are also well known in the art. For example, U.S. Pat. No. 7,614,614 to Sabadicci & Nelson discloses a venturi apparatus for facilitating the mixture of fluid substances. The tubular apparatus is flared on both ends, constricted in the middle, and vented to atmosphere at the constricted middle section. When passing a fluid through this apparatus the fluid pressure is lowered creating a vacuum drawing in a second fluid. Pouring a fluid such as wine into this venturi device will mix atmospheric air and wine and thus aerate the wine. However, the larger intermediate passageway is not designed to accept a corked bottle or cork and the constriction is not threaded to receive a corkscrew and has no other features common to a corked bottle opener and therefore the apparatus will only mix fluids and cannot be used to open a corked bottle. Other aeration apparatus know in the art, U.S. Patent Application No. 2010/0058933 by Cheng, U.S. Pat. No. 5,595,104 to Delaplaine, and U.S. Patent Application No. 2010/0011967 by Barberio, also aerate fluids, none have common features associated with a corked bottle opener and cannot be used to open corked bottles.

In prior art there has been no attempt to combine a corked bottle opener and fluid aerator, however, there have been apparatus designed to reduce the amount of manual force required to remove the cork from a corked bottle. One example, U.S. Pat. No. 4,703,673 to Allen comprises a corkscrew, a handle and a holder. The handle includes at least one elongated arm attached to the corkscrew. While rotating the elongated arm for cork removal the hand is positioned further from the center of the bottle making it more difficult to control the bottle with the opposite hand. Another example of prior art, U.S. Pat. No. 4,276,789 to Allen, discloses a Self Pulling Corkscrew apparatus comprised of a corkscrew and holder. The holder is designed to align the corkscrew to the cork with longitudinally extending, evenly spaced, gripping elements. With the corkscrew in the holder, the apparatus is placed on a corked bottle, the handle is gripped with the fingers and turned clockwise until the cork is wormed into the cork and removed from the bottle. The handle cannot be gripped with a full hand. The cork is removed from the holder by turning the handle in a counterclockwise direction while simultaneously holding the cork with the opposite hand. The cork must be held to prevent the cork from rotating as the corkscrew is unscrewed from the cork.

Continuing with U.S. Pat. No. 4,276,789 to Allen, with another embodiment, the holder includes a bushing allowing the corkscrew to be threaded into the holder and allowing the apparatus to be turned clockwise to remove the cork thus avoiding a full piercing of the cork. The holder and corkscrew are turned as one unit. However, this method requires gripping and squeezing the longitudinally extended gripping elements onto the bottle while rotating the holder, limiting any advantage this embodiment has to remove the cork easily from the bottle with a full hand grip. The holder is designed to grip the bottle rather then rotate freely around the bottle. The more the user squeezes the apparatus the tighter the apparatus will be to the bottle and thus creating more friction to overcome. The holder has guide means to the bottle but does not offer a bearing surface for the bottle nozzle to glide on as the holder is rotated to remove the cork. Additionally, the said bushing is only designed for a corkscrew and not designed to be a constriction for a venturi and due to the plurality of the longitudinally extending, evenly spaced, gripping elements the apparatus cannot receive or channel a fluid.

Accordingly, there is a substantial need in the art for a combined corked bottle opener and fluid aerator that is simple, easy to use, and easy to produce. Likewise, there is a need in the art for a corked bottle opener that allows the user to have full control of the opener and bottle while removing the cork from the bottle.

BRIEF SUMMARY

The present invention specifically addresses and alleviates the above-identified deficiencies in the art. In this regard, the present invention is directed to open a corked bottle and aerate the fluid contents of said bottle. The invention is directed to combine the functionality required to open a corked wine bottle with the additional functionality required to aerate the wine of said bottle. Further, the present invention allows an ergonomic full hand grip on the holder and bottle allowing full control of the corked bottle opener and bottle easing removal of the cork from the bottle. With a built in cork stop, the cork is easily removed from the apparatus without having to hold the cork. The extracted cork can then be used to reseal the bottle as the cork is not punctured top to bottom when it is removed from the bottle.

According to a preferred embodiment, the invention comprises a vertical holder with longitudinal axis and helical cork-engaging member. The invention enables the holder to provide guide means for the cork-engaging member and a fluid flow path for fluid aeration through the holder such that a fluid can flow into and through the holder. The cork-engaging member is comprised of a corkscrew operative for engaging the cork and holder, and a handle operative to rotate the corkscrew for engagement and disengagement and for abutment means to the top of the holder.

The holder is generally configured with a plurality of vertically aligned sections or passageways and open to atmosphere on both ends. The holder comprising, a first section operative to receive a corked bottle neck and a fluid, a second section operative to receive a cork and a fluid, a third section, threaded and having a reduced area, operative to receive the cork-engaging member and fluids, and a forth section operative to receive the cork-engaging member and fluids. At least one air inlet connects the threaded third section with the exterior of the holder to vent the third section to atmosphere. However, more then one air inlet can be used to connect the interior of the threaded third section with the exterior of the holder. Between the first and second section is a stop operative to prevent the corked bottle from entering the second section. The stop also functions as a bearing surface when the holder is rotated on the top of the bottle when removing the cork from the bottle. Between the second and third section is a cone shape operative for a cork stop and to funnel fluid from the second section into the third section. Between the third and forth section is a cork-engaging member, alignment shoulder.

The narrow third section of the holder is threaded to engage the cork-engaging member and is also optimized to allow a passing fluid to increase in velocity and thus lower the fluid pressure creating a venturi. A venturi is normally comprised of a short piece of narrow tube between wider sections to increase fluid velocity and a corresponding decrease in fluid pressure creating a vacuum, the vacuum drawing in a second fluid combining the first fluid with the second fluid. The invention is comprised of a plurality of vertically aligned sections defining a fluid pathway with a narrowed section optimized to aerate a fluid, and engage the cork-engaging member. The invention takes advantage of the requirements for a corked bottle opener with the requirements of a fluid aerator and combines those requirements into one apparatus.

To use the invention as a bottle opener, the cork-engaging member will be positioned to the holder and inserted into the forth vertical section optimized to align the cork-engaging member to the threads. Rotating the cork-engaging member into the threads will engage and center the cork-engaging member into the holder. The holder is positioned onto the corked bottle and the bottle is inserted to the stop inside the first vertical section of the holder, centering the holder to the bottle and centering the cork-engaging member to the cork. While holding the bottle with one hand, the cork-engaging member is turned clockwise into the holder and into the cork until the abutment on the cork-engaging member handle meets the abutment on the holder. While continuing to hold the bottle with one hand, the holder is then gripped with a full hand and rotated, rotating the threads inside the holder. The thread engaged corkscrew is not rotated as the holder is rotated forcing the corkscrew to travel up along the threads, pushing the corkscrew upward away from the bottle, pulling the engaged cork upward. Continued rotation of the holder will remove the cork from the bottle. Alternatively, when removing the cork, the holder can be gripped and held stationary with one hand, and the bottom of the bottle can be gripped and turned with the other hand.

To remove the cork from the holder the corkscrew is rotated counterclockwise from the holder. As the corkscrew is turned counterclockwise and continues to move upward along the thread, the cork will hit the stop, forcing the cork from the corkscrew. The cork does not have to be held with one hand while the corkscrew is unscrewed from the cork. The cork will be forced from the corkscrew by means of the cork stop without additional gripping of the cork or squeezing the holder to grip the cork. The cork holding section is large enough to allow the cork to fall out of the holder after the cork-engaging member is turned out of the cork. Using this method will prevent the cork from being pierced from top to bottom and will enable the cork to be reused to seal the bottle.

Alternative method to open a corked bottle with the invention would be to rotate the holder with the cork-engaging member simultaneously. This alternative method will pierce the cork top to bottom and can be used when resealing the bottle with the cork is not a requirement. This method uses the previous method with the exception of turning the holder with the cork-engaging member whilst removing the cork. Continuing to hold the bottle with one hand, the holder and the handle on the cork-engaging member are both turned simultaneously. A full hand can still grasp the holder but a finger or thumb will be used to hold the cork-engaging member to the top of the holder so both rotate as one. As the cork-engaging member and holder are turned simultaneously, the corkscrew will worm into the cork pulling it from the bottle. Continued rotation will remove the cork from the bottle. To remove the cork from the holder the same method is used as stated above.

To use the invention as an aerator to aerate a fluid such as wine, the cork-engaging member is first removed from the holder. With the first vertical section facing up on the holder, the fluid is poured into the holder and will flow from the first section, into the second vertical section flowing onto the cone shape, and funneling into the third vertical section. The third vertical section is narrower then the second vertical section and will constrict the fluid flow, increasing fluid velocity, lowering fluid pressure and creating a vacuum. By means of the venturi effect, a second fluid is then drawn into the third section and introduced to the first fluid through an air inlet, connecting the third section to the exterior of the holder. The air inlet, opposite to the helical thread, is operative to fluidly assimilate and mix the first and second fluids. The two fluids will continue to mix as they flow into and out of the forth vertical section combining the first fluid, wine, with the second fluid, atmospheric air and thus aerating the wine.

DESCRIPTION OF THE DRAWINGS

Figures

DESCRIPTION OF THE DRAWINGS

Reference Numerals

The following list refers to the drawings:

| Ref # | Description |
|---|---|
| 1 | Holder |
| la | Exterior of holder |
| 1b | Holder Abutment end to Cork-engaging member |
| 2 | Opening |
| 3 | Cork-engaging Member and Fluid Receiving Section |
| 3b | Shoulder |
| 4 | Threads |
| 5 | Reduced Area Section |
| 6 | Air Inlet |
| 7 | Cone Shape |
| 8 | Cork and Fluid Receiving Section |
| 9 | Corked Bottle Stop |
| 10 | Corked Bottle and Fluid Receiving section |
| 11 | Opening |
| 12 | Cork-engaging Member |
| 12a | Corkscrew |
| 12b | Corkscrew Handle |

DETAILED DESCRIPTION OF PREFERRED EMBODIMENT

The invention will generally be used atop an upright bottle when used as a corked bottle opener or will be used over a container when used as an aerator. Terms, such as, "top", "bottom", "upper", "lower", refer to the illustrations and are intended to aid in describing the illustrated embodiments and are not intended to limit how the invention can be transported, handled, or stored. Further, the detailed description below is not intended to represent the only embodiment of the invention.

Figure 1:
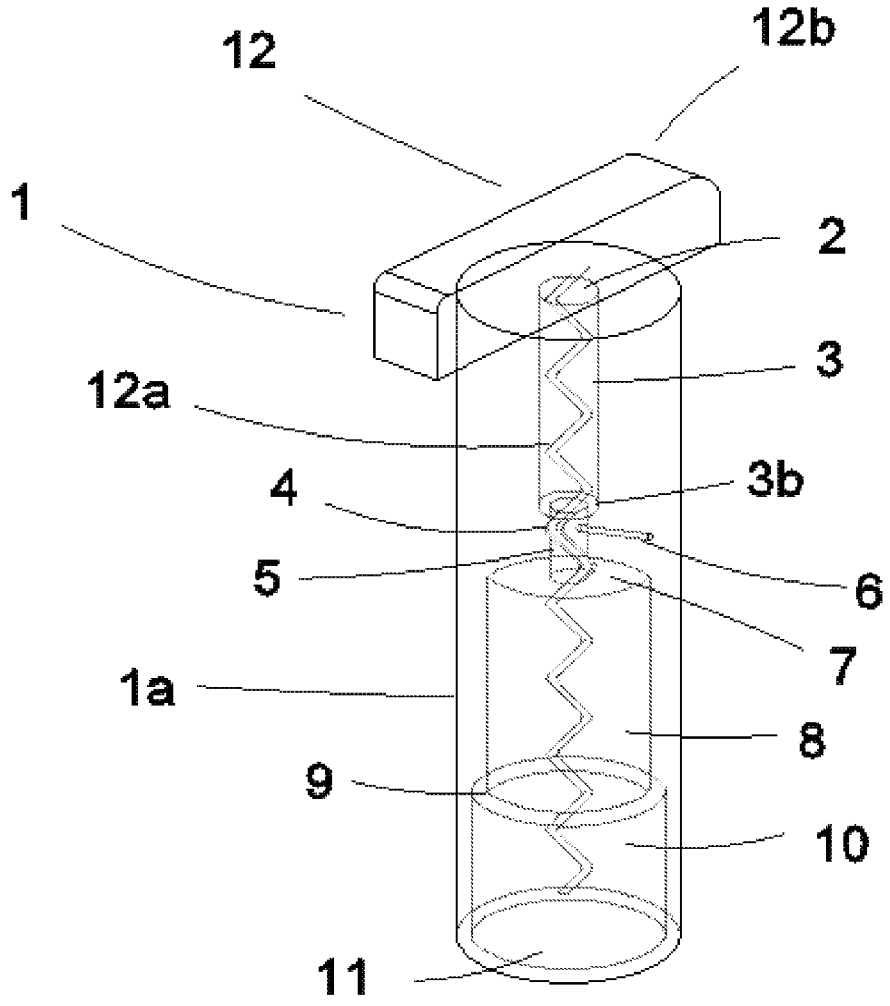
FIG. 1 is a transparent, perspective view in the corked bottle opener position.
Figure 2:
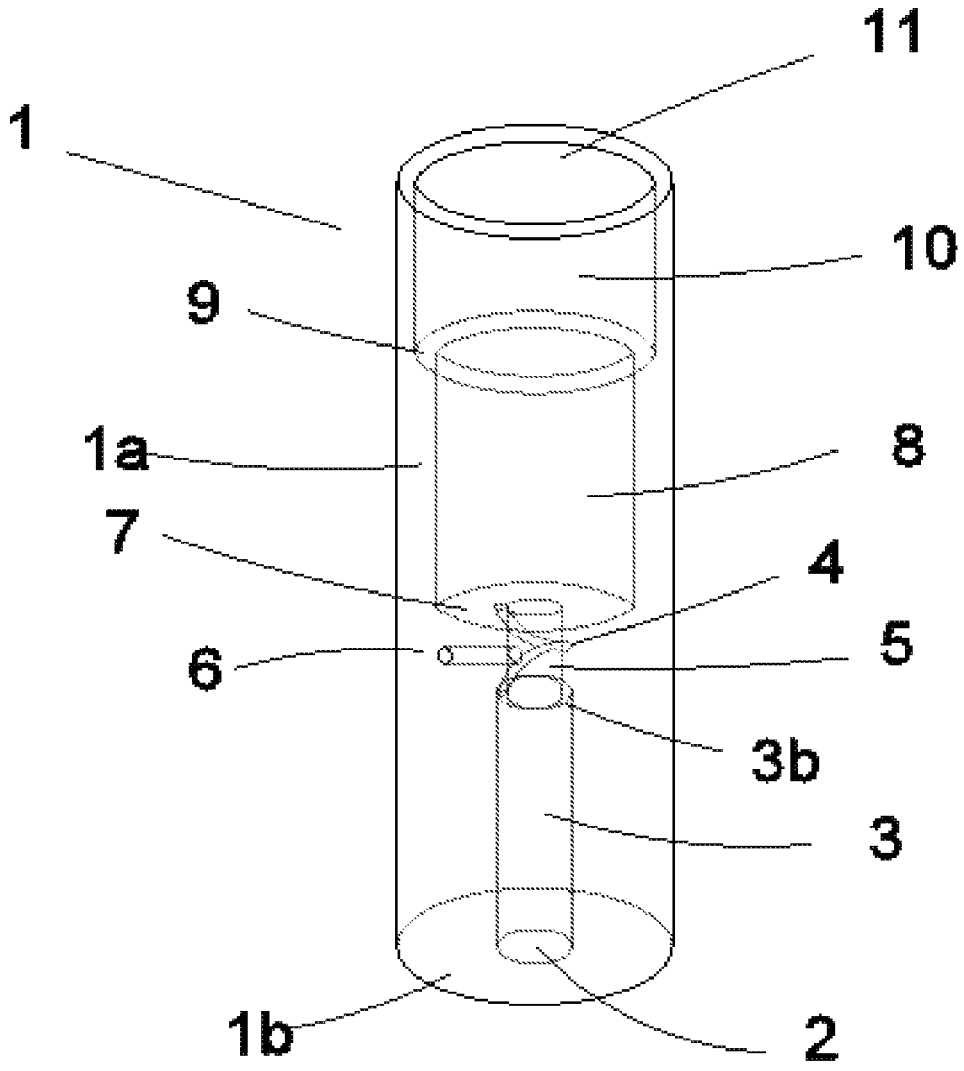
FIG. 2 is a transparent, perspective view in the fluid aerator position.
Figure 3:
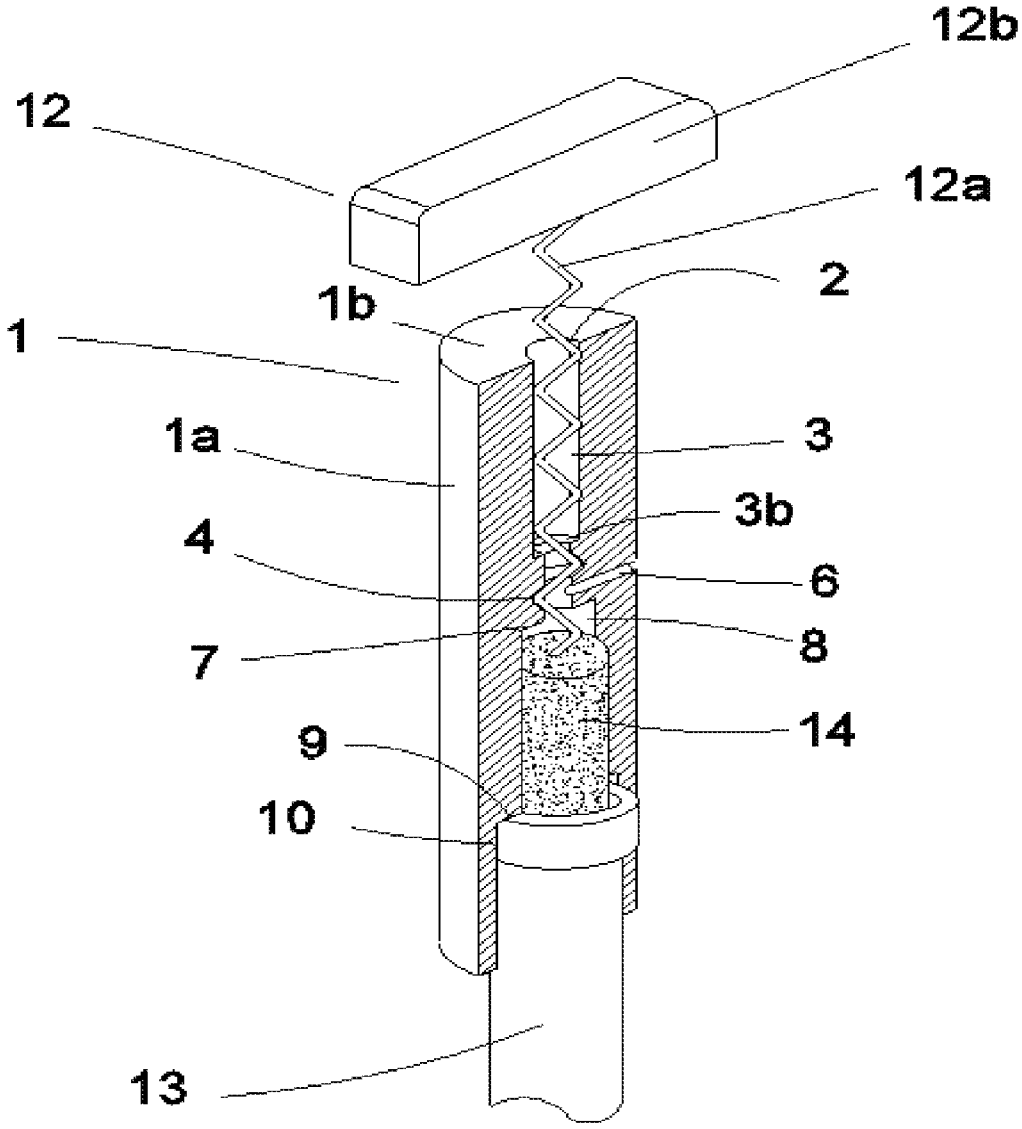
FIG. 3 is a cutaway, perspective in the cork removal position.

Referring now to a particular embodiment, FIGS. 1, 2, and 3 generally illustrate the component parts of a corked bottle opener and fluid aerator. The invention generally comprises two main parts, a holder 1 and a cork-engaging member 12. The cork-engaging member 12 combined with the holder 1 are used cooperatively for opening a corked bottle 13. The holder 1, without the cork-engaging member 12, is used to aerate a fluid. Components of the invention have more then one function and are clarified below.

The holder 1 provides guide means for the cork-engaging member 12 and a fluid flow path through the holder 1 for fluid aeration. A venturi is a common method for fluid aeration and is normally comprised of a short piece of narrow tube between wider sections to increase fluid velocity and corresponding decrease in fluid pressure creating a vacuum in order to combine two or more types of fluids. One fluid is poured into the first funnel section and then restricted by means of a narrow passageway causing the first fluid's pressure to decrease drawing in an additional fluid to mix with the first fluid. The holder's 1 internal configuration is not only optimized to cooperatively work with the cork-engaging member to remove a cork from a corked bottle, it is also optimized to define a constricted fluid pathway to aerate a fluid with a venturi. The invention utilizes reduced area 5 to engage the corkscrew 12*a* and to constrict fluid flow allowing the invention to have more then one function.

The embodiment in FIG. 1 illustrates the holder 1 in the corked bottle opener position with the cork-engaging member 12 threaded and engaged into the holder 1. FIG. 2. illustrates the same embodiment of the holder in the fluid aeration position without the cork-engaging member 12. The top of the holder 1*b* provides abutment means to the cork-engaging member handle 12*b* and prevents further downward motion of the cork-engaging member 12 into the holder 1. Planar and centered to the top of the holder 1*b* is opening 2 operative to receive the corkscrew 12*a* and a fluid. Coupled and below opening 2 is the corkscrew and fluid receiving section 3 operative to align the cork-engaging member 12 to the threads 4 and to funnel fluids away from a reduced area 5. The corkscrew and fluid receiving section 3 is between shoulder 3*b* and the opening 2. The shoulder 3*b* aligns the corkscrew 12*a* to the thread 4. Coupled to and below the shoulder 3*b* is reduced area 5, smaller in diameter then the corkscrew and fluid receiving section 3, operative to receive a fluid from the cone shape 7 and threaded to engage the corkscrew 12*a*. The thread 4 is larger in diameter and spirals around the smaller diameter reduced area 5. The helical shaped thread 4 is large enough in diameter and has the correct thread pitch to allow the cork-engaging member 12 to be threaded into and engage the threads 4 and in so doing engaging the holder 1. The air inlet 6 connects the reduced area 5 with exterior of the holder 1*a* and atmosphere and provides means for said atmosphere to enter the reduced area 5. Connecting the reduced area 5 with the larger cork and fluid receiving section 8 is a cone shape 7. The cone shape 7 provides stop means for the cork 14 and is operative to funnel fluid. The cork and fluid receiving section 8 is operative to receive a cork and to capture a fluid before it funnels into the reduced area section 5 via the cone shape 7. Separating the cork and fluid receiving section 8 and corked bottle and fluid receiving section 10 is a stop 9, used to prevent the inserted corked bottle 13 from entering the cork and fluid receiving section 8 and is also a bearing surface for rotation of the holder 1 along the top of the bottle 13. The corked bottle and fluid receiving section 10 is operative to receive a corked bottle neck and a fluid and is coupled to opening 11.

In this particular embodiment Illustrated in FIG. 1, the holder 1 is generally made from a ridged, inflexible, non-porous, material that may include plastic, glass, metal, or other ridged material or combination thereof. Generally, the materials used for the holder will be food safe and non-porous as the holder 1 will be in contact with fluids such as wine to be consumed after aeration. The holder 1 is a machined or molded one piece part or a combination of machined and molded parts combined to work as one part by means to those familiar in the art. The shape and size of the holder 1 allows the holder 1 to be gripped with a full hand while rotating, enabling easy removal of the cork 14 from the bottle 13. The ridged material of the holder 1 cannot be compressed or distorted by hand when using a full hand. Additionally, the ridged inflexible holder 1 allows the holder 1 to maintain a correct shape while the holder 1 is rotated and the cork-engaging member 12 pulls the cork 14 from the bottle 13. For the cork-engaging member 12, the holder 1 provides abutment means at the top of the holder 1*b* and engagement means at the threads 4. For a corked bottle 13, the holder 1 provides stop means at stop 7 as well as means to hold the cork 14 while it is being removed from the bottle 13.

Referring again to a particular embodiment in FIG. 1, the cork-engaging member 12 is comprised of a corkscrew 12*a*, operative for engaging the cork 14 and threads 4 of the holder 1, and a handle 12*b* operative to rotate the corkscrew 12*a* for engagement and disengagement to the holder 1 and cork 14 and for abutment means to the top of the holder 1*b*. Generally the corkscrew 12*a* is made from metal and may be coated with a friction reducing material such as Teflon or similar plastic. It is not necessary to drive the corkscrew 12*a* completely through the cork 14 and does not require the corkscrew 12*a* to be coated with Teflon. The invention can accommodate either coated or non-coated corkscrews 12*a* or method of use and will function normally with or without a Teflon coated corkscrew 12*a*. When the corkscrew 12*a* is fully engaged to the holder and the abutment on the handle 12*b* meets the abutment on the holder 1*b* the corkscrew 12*a* will be slightly shorter then holder 1. When the holder 1 is placed on the corked bottle 13 and the corkscrew is turned into the holder 1 and then into the cork 14, the corkscrew 12*a* will engage the cork 14 with enough engagement to remove the cork 14 from the bottle 13 without breaking the cork 14, generally engaging the cork past mid section. The corkscrew 12*b* is generally perpendicular and at midpoint of the handle 12*b*.

Referring to the embodiment in FIGS. 1 and 2, the corkscrew 12*a* and fluid receiving section 3 is operative to receive the corkscrew 12*a* when the holder 1 is used as a bottle opener and fluids from reduced area 5 when the holder 1 is used as an aerator. The corkscrew 12*a* and fluids receiving section 3 has shoulder 3*b* at one end and opening 2 at the other. The shoulder 3*b* is used to align the corkscrew 12*a* to the thread 4. As the corkscrew 12*a* is turned inside the corkscrew and fluids receiving section 3 the corkscrew 12*a* will ride along the shoulder 3*b* until the thread is met, engaging the corkscrew 12*a* to the thread 4. Continued rotation of the corkscrew 12*a* will fully engage the corkscrew 12*a* to the threads 4. When used as an aerator, the corkscrew and fluids receiving section 3 receives fluids from reduced area 5. As fluids enter the corkscrew and fluids receiving section 3 velocity of the fluids slow down, fluid pressure increases, and the fluids continue to mix and assimilate as the fluids exit the holder 1 via opening 2.

The reduced area 5 and thread 4 of FIGS. 1 and 2 defines a narrowed fluid passageway and corkscrew 12*a* engagement section. In this particular embodiment, passageway 5 is coupled to shoulder 3*b* on one end and coupled to the cone shape 7 on the other end with a helical thread 4 for corkscrew 12*a* engagement. Generally, at least one air inlet 6 is between shoulder 3*b* and the cone shape 7 and opposite the helical thread 4. The air inlet 6 connects the reduced area 5 with atmosphere and provides means for said atmosphere to enter the reduced area 5 when a vacuum is produced with a passing fluid through the reduced area section 5. Therefore, any additional air inlets would be placed on the opposite side of the helical thread 4 and would not be diametrically opposed to each other. The thread 4 allows the corkscrew 12*a* to engage with the holder 1 just as a threaded bolt would engage a threaded nut, preventing the cork-engaging member 12 from being pulled out of the threads 4. The corkscrew 12*a* has to be turned into or out of the thread 4 when engaging or disengaging with the holder 1. The cork engaging member 12 can only be screwed into the holder 1 until the abutment on the handle 12*b* meets the abutment on the top of the holder 1*b*. The threads 4 are centered in the holder 1 and will center the corkscrew 12*a* over the corked bottle 13 when the holder 1 is placed onto the bottle 13.

Continuing with FIGS. 1 and 2, separating reduced area 5 from the larger cork and fluid receiving section 8 is a cone shape 7. When used as a corked bottle opener, the cone shape 7 provides stop means for the cork and when used as an aerator the cone shape 7 provides means to funnel a fluid. The cork and fluid receiving section 8 and the corked bottle and fluid receiving section 10 align cooperatively with the cone shape 7 to form a fluid reservoir to stabilize and funnel a fluid to reduced area 5. The corked bottle and fluid receiving section 10 is large enough to insert a corked bottle 13 and provides additional fluid reservoir volume. The cork and fluid receiving section 8 and corked bottle and fluid receiving section 10 are separated by a stop 9, used to prevent the corked bottle 13 from entering the cork and fluid receiving section 8 and provide a bearing surface between the holder 1 and the corked bottle 13. The stop 9 has a smooth surface and abuts to the top of the corked bottle 13 allowing the holder 1 to ride along the top of the corked bottle 13 during cork 14 removal. The depth of the corked bottle and fluid receiving section 10 allows the corked bottle 13 to engage the holder 1 allowing the corkscrew 12*a* to engage the cork 14 with enough engagement to prevent the cork 14 from breaking prior to being pulled from the bottle 13. Preferably the corkscrew 12*a* will engage the cork 14 past midpoint when the cork-engaging member 12 is fully engaged to the holder 1.

As an aerator, a fluid enters the holder at opening 11 and continues to flow down into the corked bottle and fluid receiving section 10 and cork and fluid receiving section 8 and then onto the cone shape 7. The reduced area 5 prevents the fluid from passing through the holder 1 at the same rate that can be collected in said reservoir allowing the fluid to collect and become less turbulent before entering the reduced area 5. The less turbulent fluid flows with more velocity through reduced area 5 and correspondingly has a lower pressure creating more vacuum. More vacuum draws in more fluid through air inlet 6 to mix with the passing first fluid. As a bottle opener, the cone shape 7 abuts to the cork 14 when the cork-engaging member 12 is removed from the cork 14. As the cork-engaging member 12 is turned counterclockwise to remove the cork 14, and as the corkscrew 12*a* travels along the thread 4, the cork 14 will come into contact with the cone shape 7 and be forced off the corkscrew 12*a*. After the corkscrew 12*a* is removed from the cork 14 the cork 14 will fall out of the cork and fluid receiving section 8 and out of the holder 1.

Figure 4:
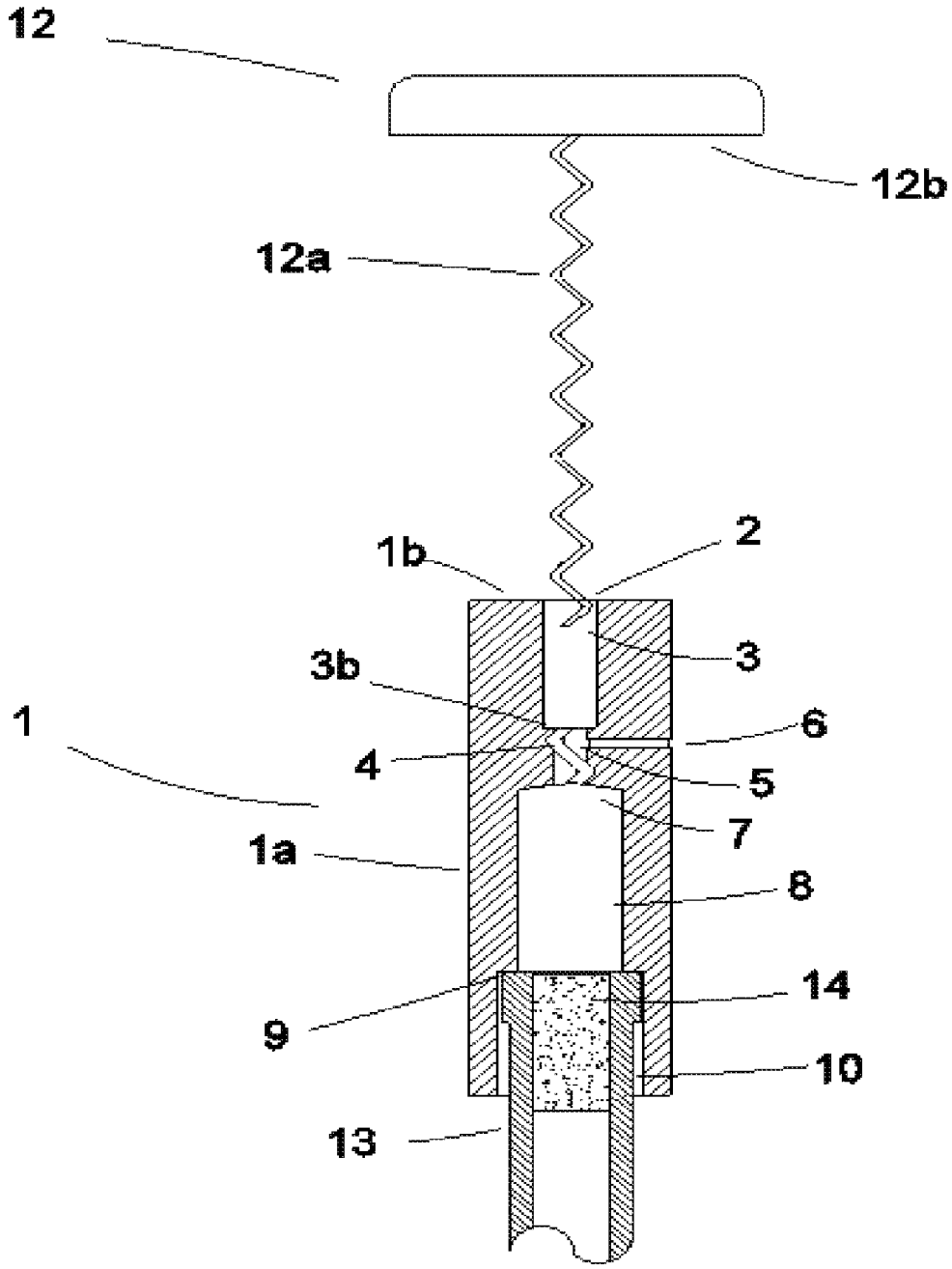
FIG. 4 is a cross-sectional view with the cork-engaging member 12 inserted into the holder 1.
Figure 5:
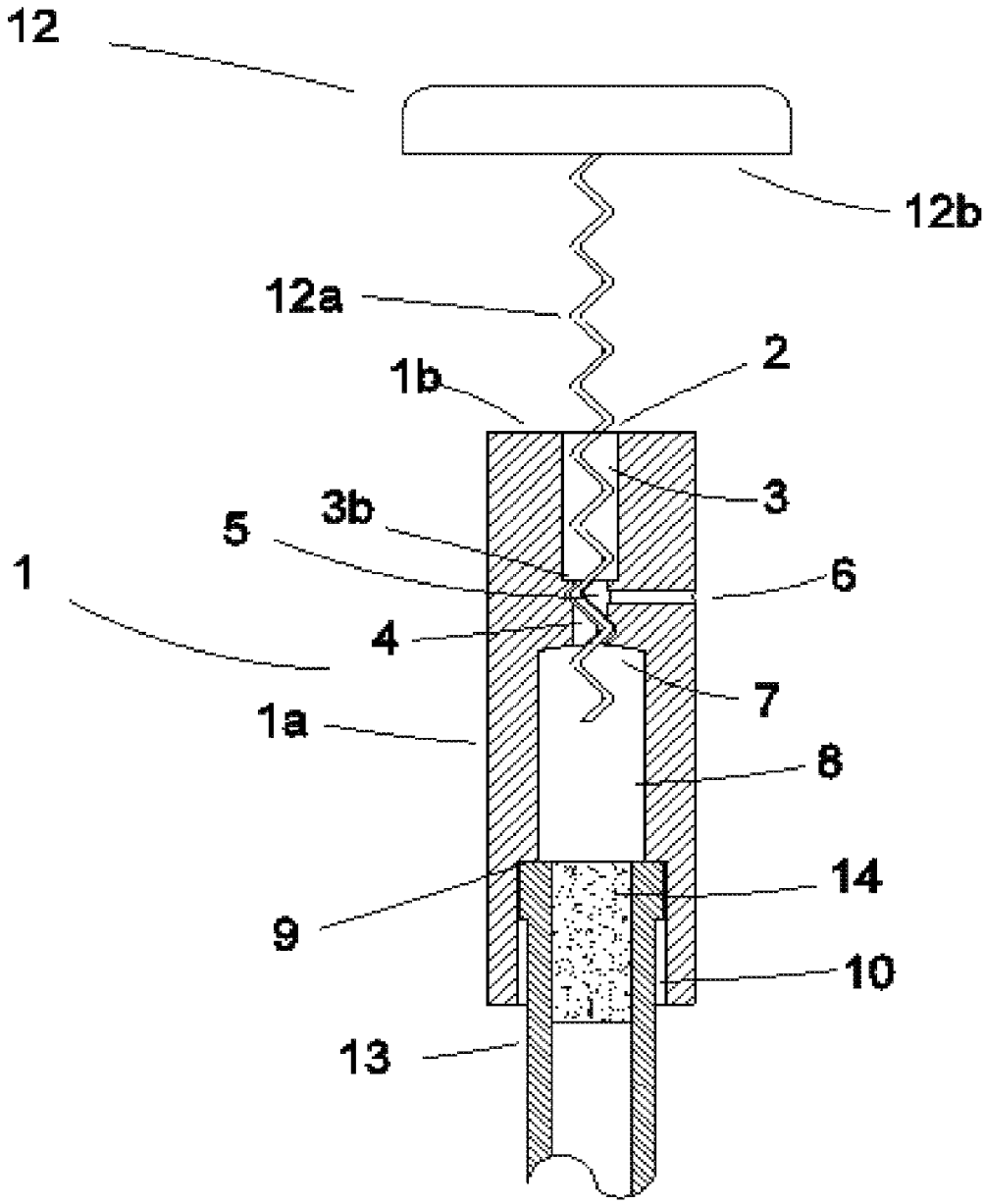
FIG. 5 is a cross-sectional view with the corked-engaging member threaded into the holder 1.
Figure 6:
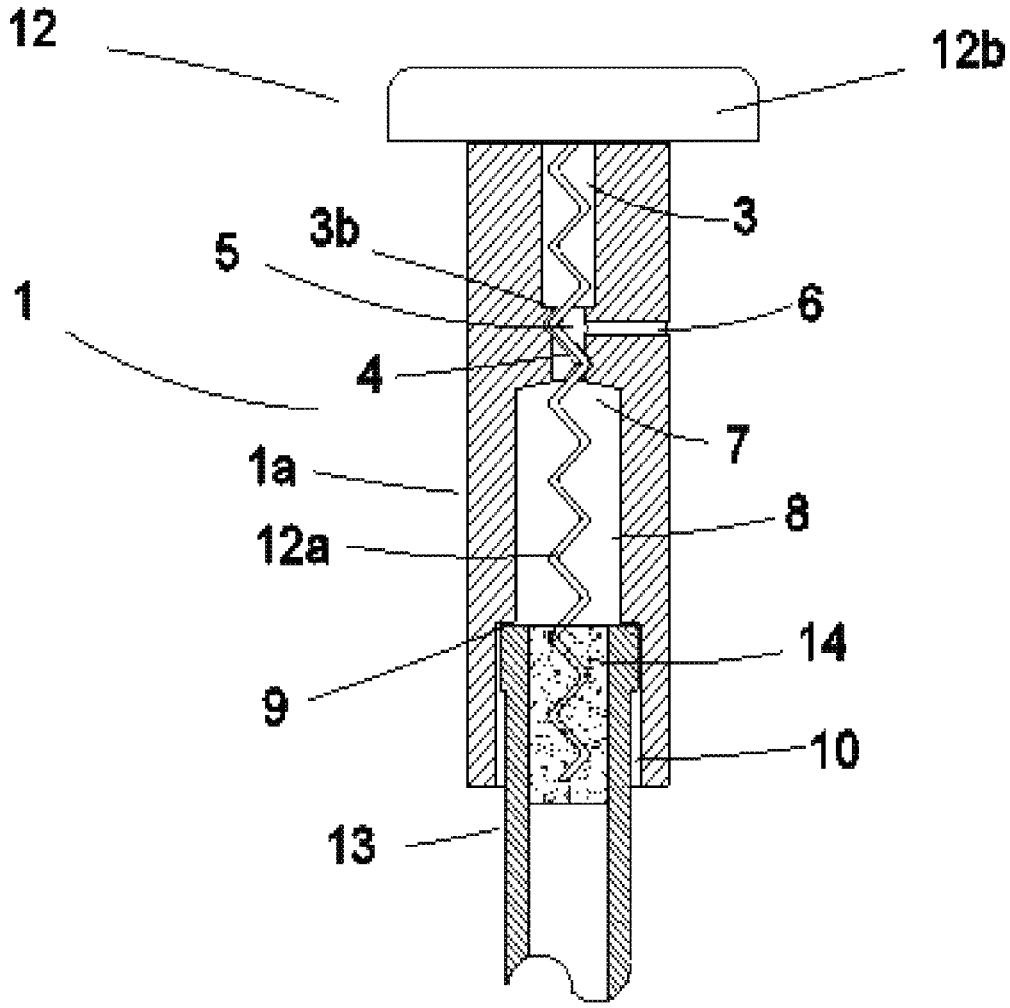
FIG. 6 is a cross-sectional view with the corked-engaging member threaded into the holder 1 and engaged into the cork 14.
Figure 7:
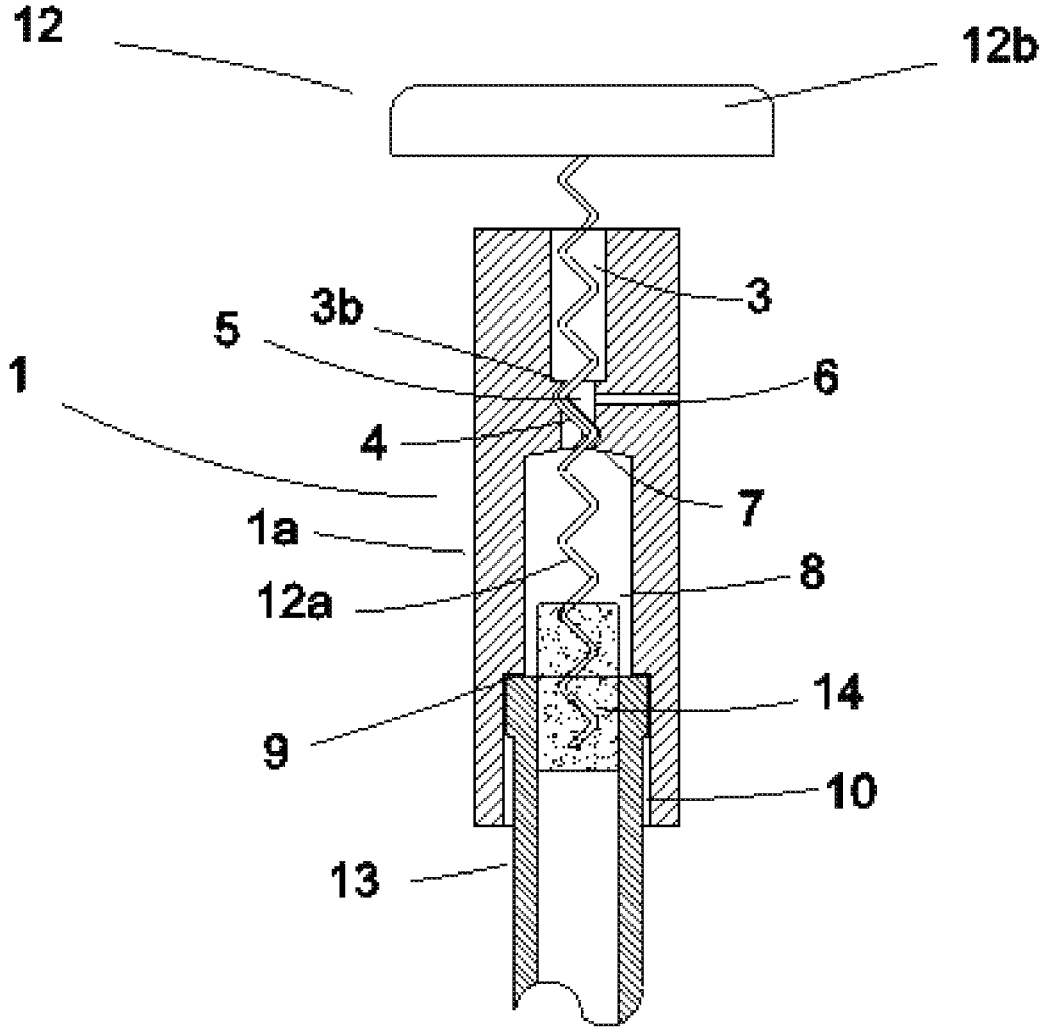
FIG. 7 is a cross-sectional view with the apparatus extracting the cork 14 from the corked bottle 13.
Figure 8:
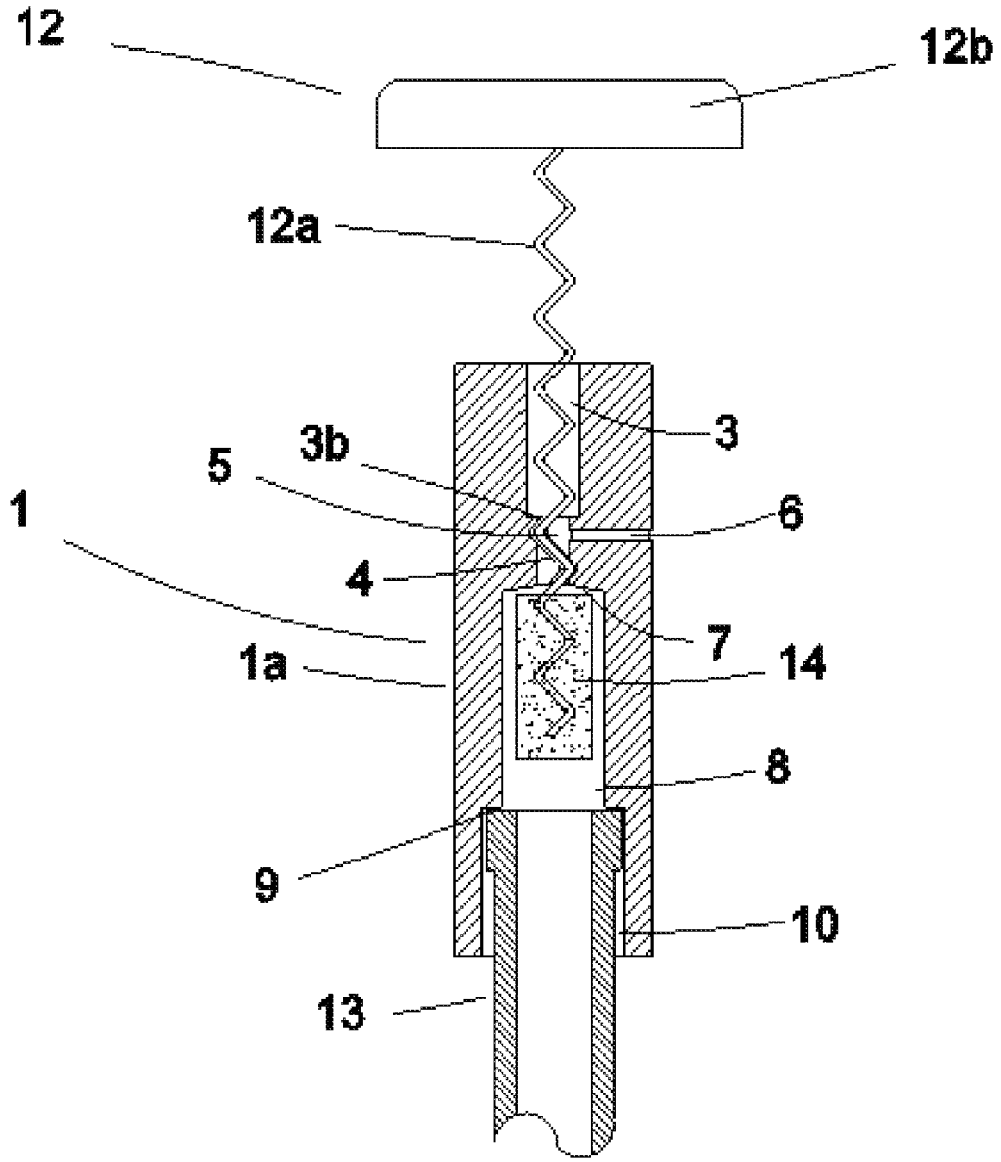
FIG. 8 is a cross-sectional view with the cork 14 extracted from the bottle 13.
Figure 9:
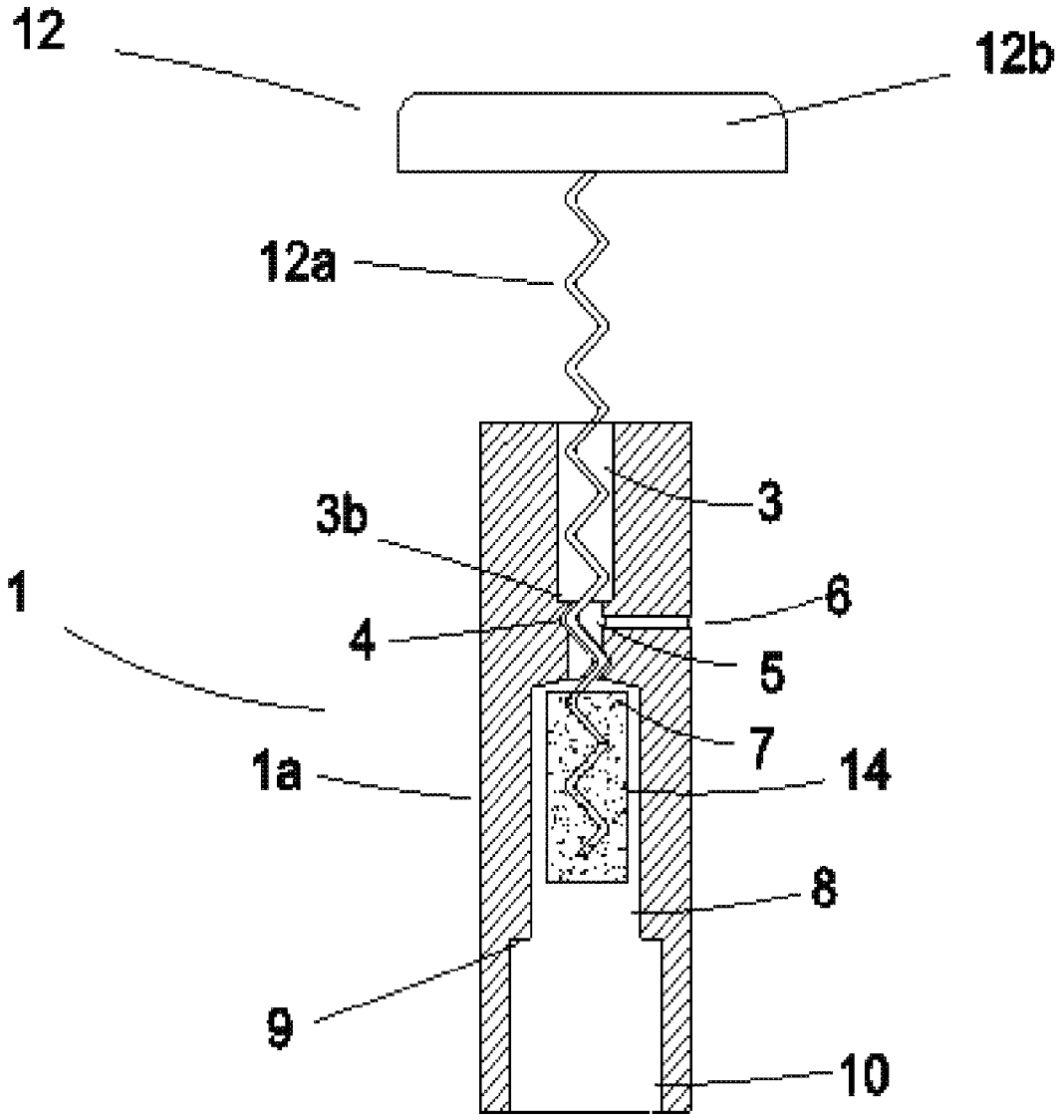
FIG. 9 is a cross-sectional view with the holder 1 removed from the bottle 13.
Figure 10:
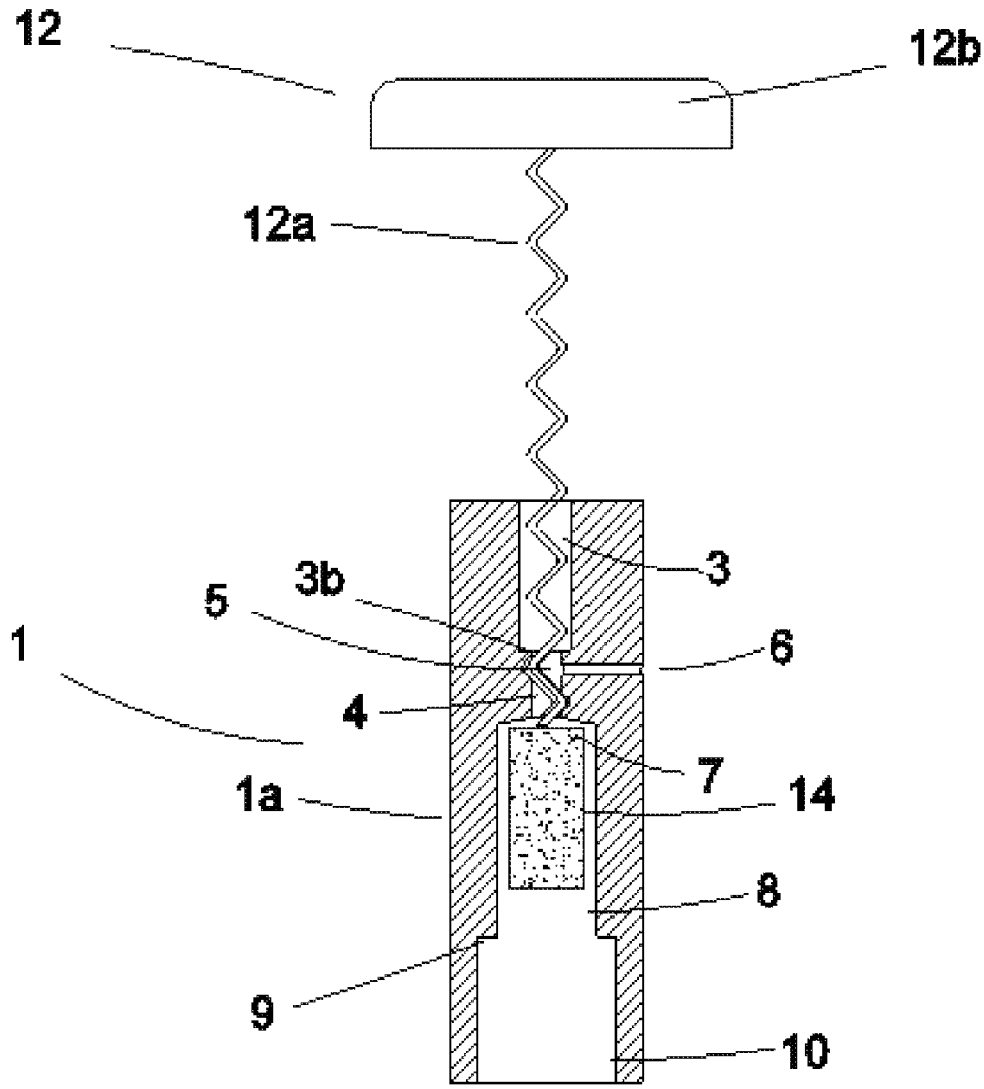
FIG. 10 is a cross-sectional view with the cork-engaging member 12 removed from the cork 14.
Figure 11:
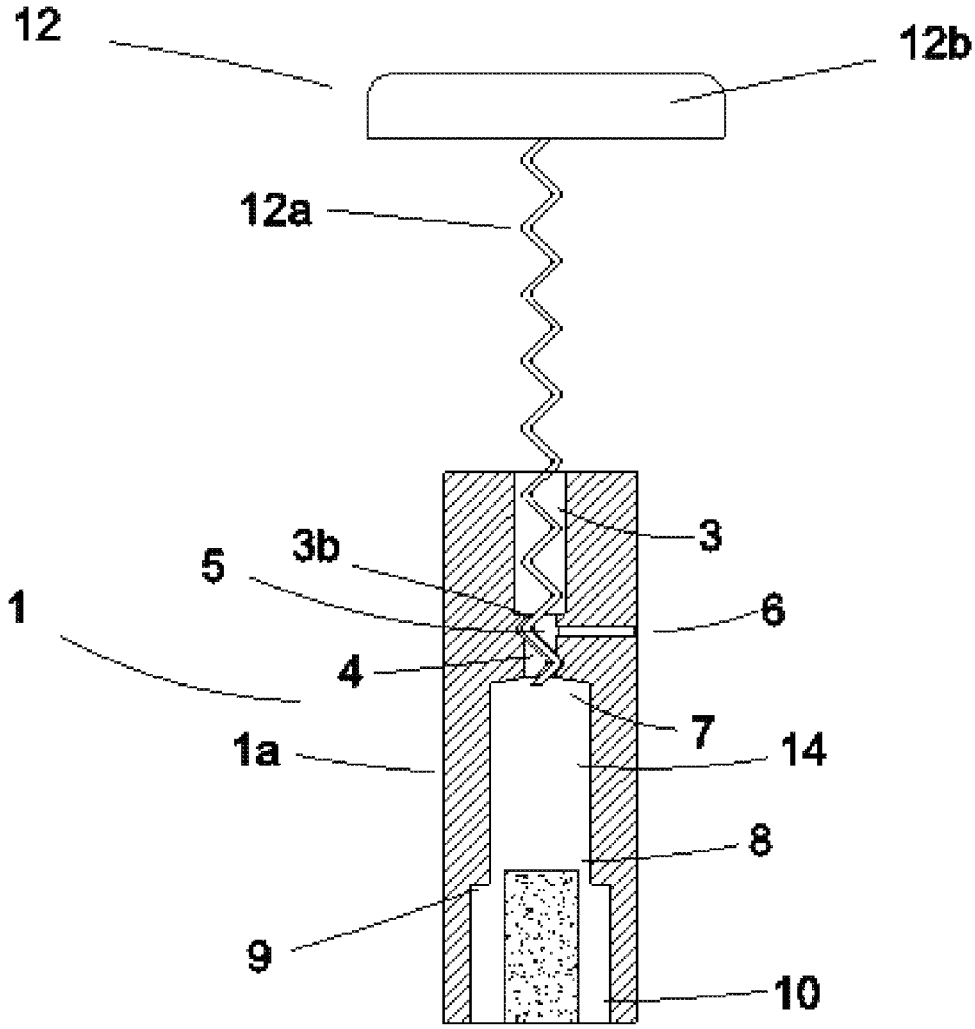
FIG. 11 is a cross-sectional view with the cork 14 removed from the cork and fluid receiving section 8.

To use the invention as a bottle opener, position the corkscrew 12*a* to the holder 1 and insert into opening 2 as illustrated in FIG. 4. Continue to insert corkscrew 12*a* into the corkscrew and fluid receiving section 3 until the corkscrew 12*a* meets the shoulder 3*b*. Rotate the cork-engaging member 12 clockwise and thread the corkscrew 12*a* into the threads 4, centering and engaging the corkscrew 12*a* to the holder 1 as illustrated in FIG. 5. Before continuing to thread the cork-engaging member 12 past the threads 4 and into the cylindrical passageway 8, position the holder 1 onto the corked bottle 13 and insert the bottle 13 to the stop 9, centering the holder 1 to the corked bottle 13 and centering the corkscrew 12*a* to the cork 14. Referring to FIG. 6, while holding the corked bottle 13 with one hand, the cork-engaging member 12 is turned clockwise into the holder 1 and into the cork 14 until the abutment on the handle 12*b* meets the abutment on the holder 1*b*, and the corkscrew 12*a* is threaded into the cork 14. Referring to FIG. 7, while continuing to hold the corked bottle 13 with one hand, the holder 1 is gripped with a full hand and rotated, rotating the threads 4 inside the holder 1. The cork-engaging member 12 is not rotated as the holder 1 is rotated forcing the cork-engaging member 12 to travel along the threads 4, pushing the cork-engaging member 12 upward away from the corked bottle 13, pulling the cork 14 upward and away from the bottle. Continued rotation of the holder 1 will remove the cork 14 from the bottle 13 as illustrated in FIG. 8. A longer cork 14 may still be partially engaged to the bottle 13 but can be easily removed from the bottle 13 by pulling up on the holder 1. Alternatively, when removing the cork 14 from the bottle 13, the holder 1 can be gripped with one hand and the bottom of the bottle 13 can be gripped and turned with the other hand while the holder 1 is held stationary. Continuing with FIG. 8, to remove the cork 14 from the holder 1 the cork-engaging member 12 is rotated counterclockwise from the holder 1. As the cork-engaging member 12 is turned counterclockwise and continues to move upward along the thread 4, the cork 14 will hit the cone shape 7, illustrated in FIG. 9, forcing the cork 14 from the cork-engaging member 12. The cork and fluid receiving section 8 is large enough in diameter to allow the cork 14 to fall out of the holder 1 after the cork-engaging member 12 is turned out of the cork 14 as illustrated in FIGS. 10 and 11.

Figure 12:
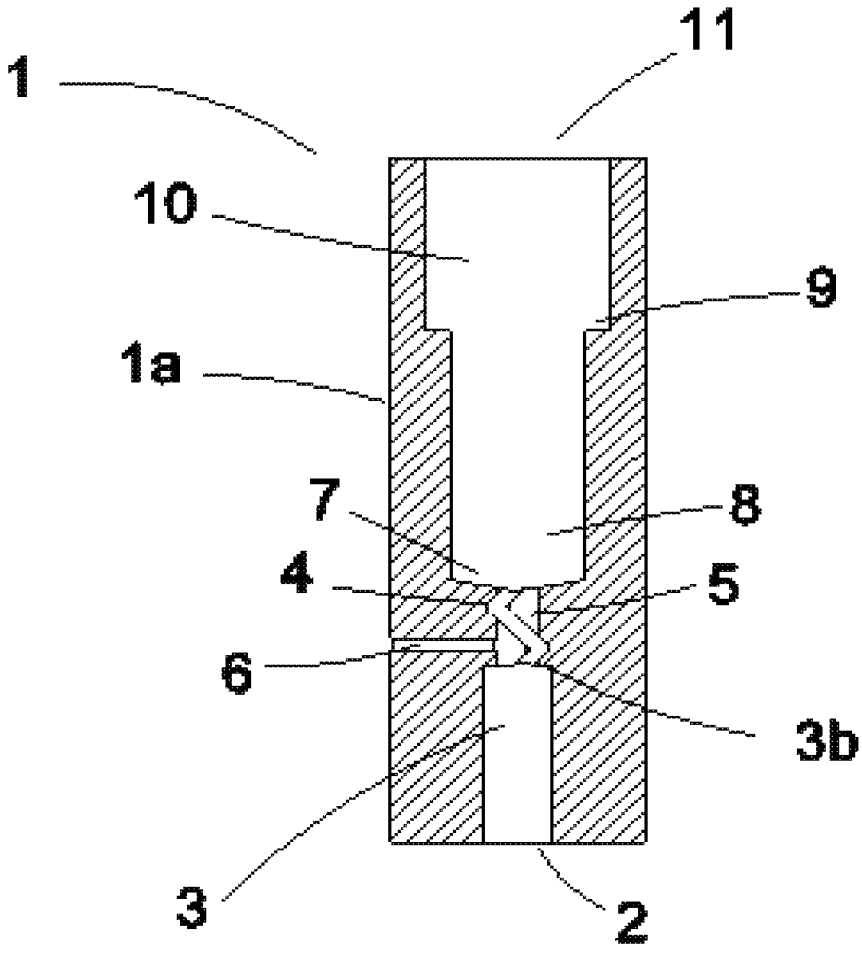
FIG. 12 is a cross-sectional view of the holder 1 in the fluid aeration position.
Figure 13:
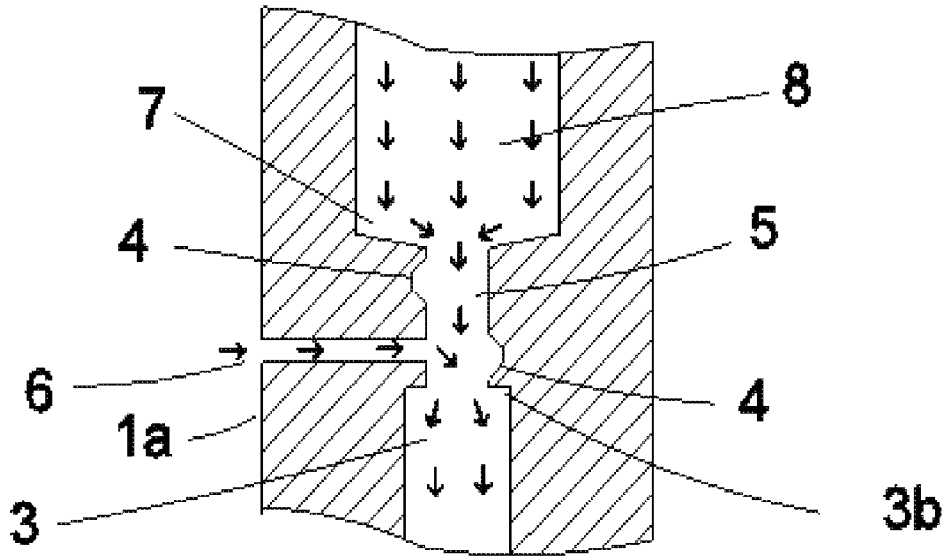
FIG. 13 is a cross-sectional view illustrating the fluid flow path through the holder 1 and from the air inlet 6 into the holder 1.
Figure 14:
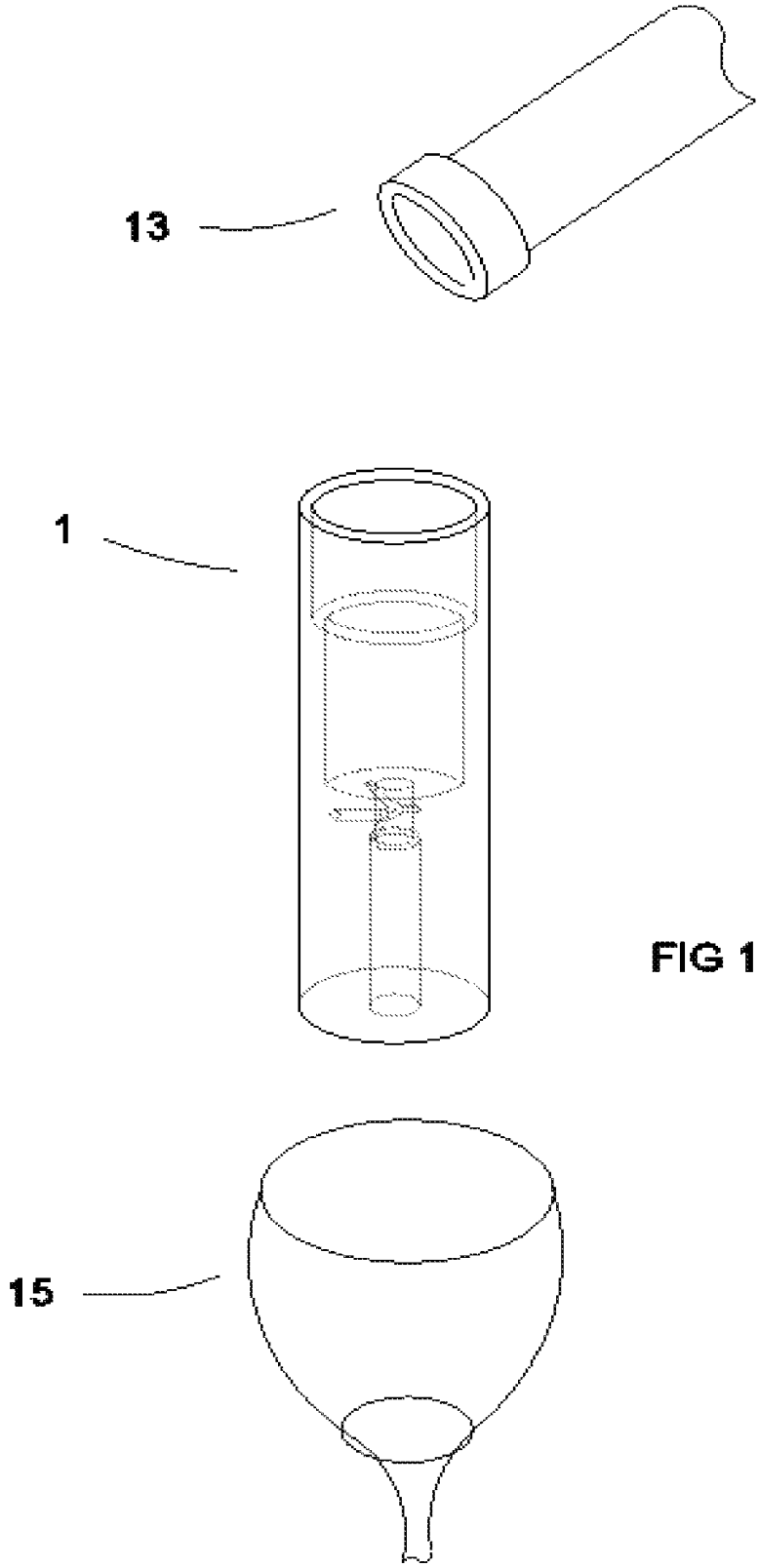
FIG. 14 illustrates the holder 1 in the fluid aeration position.

Referring now to FIGS. 12, 13 and 14, to use the invention as an aerator, the cork-engaging member 12 is removed from the holder 1. With opening 11 facing up and the holder 1 in a vertical position, a fluid is poured into opening 11 and into the corked bottle and fluid receiving section 10. The fluid will then flow into the cork and fluid receiving section 8, flowing onto the cone shape 7, and funnel into the reduced area 5. Reduced are 5 constricts the fluid flow, increasing fluid velocity, and lowering fluid pressure to create a vacuum. Due to the narrowing of the reduced area 5, more fluid will enter the cork and fluid receiving section 8 then can escape causing the fluid to collect before flowing into the reduced area 5, reducing fluid turbulence and allowing the fluid to stabilize before flowing out of the cork and fluid receiving section 8. As the fluid enters the reduced area 5, the velocity of the fluid will increase and the pressure of the fluid will decrease creating a vacuum. By means of the venturi effect, a second fluid is then drawn into the reduced area 5 and introduced to the first fluid through at least one air inlet 6 to atmosphere. The air inlet 6, opposite to the helical thread 4, is operative to fluidly couple the interior of the reduced area 5 with the exterior of the holder 1*a* allowing for atmosphere to enter the reduced area 5 when a vacuum is created with the passing fluid. The two fluids will continue to mix as they flow into and out of the corkscrew and fluids receiving section 3 combining the first fluid, wine, with the second fluid, atmospheric air and thus aerating the wine.

Figure 15:
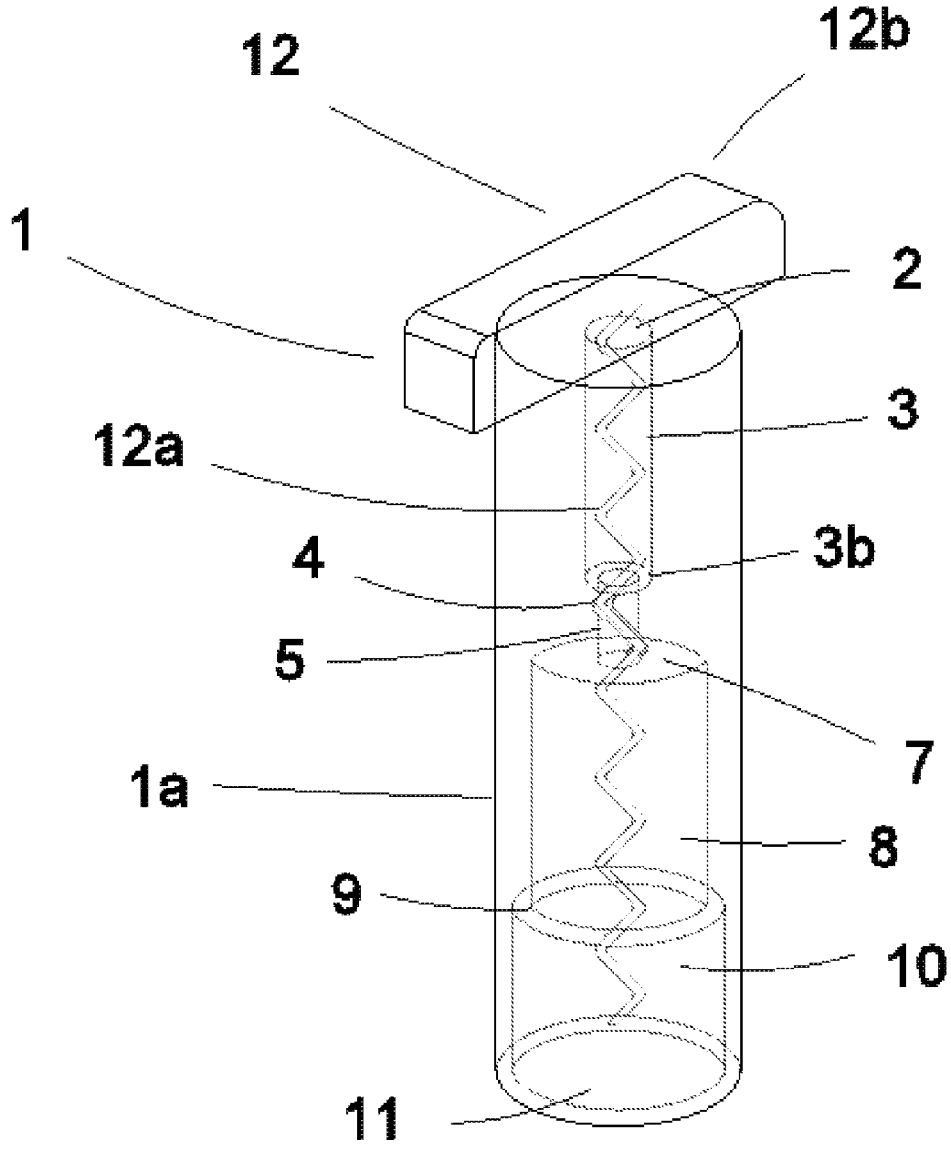
FIG. 15 illustrates another embodiment of the invention.

FIG. 15 illustrates another embodiment of the invention with the cork bottle opener without the fluid aerator allowing the invention to open a corked bottle but not aerate a fluid. The apparatus includes a holder 1 and cork-engaging member 12. The top of the holder 1*b* provides abutment means to the cork-engaging member handle 12*b* and prevents further downward motion of the cork-engaging member into the holder 1. Planar and centered to the top of the holder 1*b* is opening 2 operative to receive the corkscrew 12*a*. Coupled and between opening 2 and the shoulder 3*b* is the corkscrew receiving section 3 operative to align the cork-engaging member 12 to the threads 4. Coupled to and below the shoulder 3*b* is reduced area 5, smaller in diameter then the corkscrew receiving section 3 and threaded to engage the corkscrew 12*a*. The thread 4 is larger in diameter and spirals around the smaller diameter reduced area 5. The helical shaped thread 4 is large enough in diameter and has the correct thread pitch to allow the cork-engaging member 12 to be threaded into and engage the threads 4 and in so doing engaging the holder 1. Connecting the reduced area 5 with the larger cork receiving section 8 is a cone shape 7, providing stop means for the cork 14. The cork receiving section 8 is between the stop 9 and cone shape 7. Separating the cork receiving section 8 and corked bottle receiving section 10 is a stop 9, used to prevent the inserted corked bottle 13 from entering the cork receiving section 8 and is also a bearing surface for rotation of the holder 1 along the top of the bottle 13. The corked bottle receiving section 10 is operative to receive a corked bottle neck and is coupled to opening 11.

The embodiments presented do not represent the only possible variations of the invention. Many alternatives will be apparent to those skilled in the art. The invention is intended to embrace all such alternatives and variations as fall within the spirit and scope of the appended claims.

What is claimed is:

1. a combined corked bottle opener and fluid aerator apparatus, the apparatus comprising:

(a) a cork-engaging member including a handle and a corkscrew;

(b) a vertical holder with longitudinal axis, open to atmosphere on both ends, providing guide means for a cork-engaging member and a fluid flow path for fluid aeration through the holder such that a fluid can flow into and through the holder, the holder being defined by;

(1) a corked bottle and fluid receiving section, vertically aligned and extending inward from said open end;

(2) a stop, coupled to said corked bottle and fluid receiving section;

(3) a cork and fluid receiving section, extending inward from said stop, vertically aligned to said corked bottle and fluid receiving section;

(4) a cone shape, extending away from said cork and fluid receiving section and toward center axis of said holder;

(5) a reduced area section, coupled to and extending from said cone shape;

(6) at least one air inlet, connecting atmosphere with said reduced area section;

(7) a shoulder, extending outward from the reduced area section;

(8) a cork-engaging member and fluids receiving section, larger then said reduced area section, coupled to said shoulder extending to said open end, vertically aligned to reduced area section;

wherein the corked bottle and fluid receiving section provides for corked bottle engagement and centering means for the corked bottle to the holder and for fluid receiving; the stop providing stop means for a corked bottle and bearing means for the holder to the top of the corked bottle; the cork and fluid receiving section is operative to hold a cork extracted from the corked bottle and a fluid; the corked bottle and fluid receiving section, the cork and fluid receiving section, and said cone shape cooperatively define a fluid reservoir and funnel; the cone shape is operative to be a cork stop and fluid funnel to funnel fluid into said reduced area section; the reduced area section is threaded to engage said cork-engaging member and constrict fluid flow from said reservoir, increasing fluid speed and lowering fluid pressure of passing fluid creating a vacuum; the shoulder and said cork-engaging member and fluids receiving section cooperatively form a cork-engaging member thread alignment section and fluid exit funnel to continue mixture of first and second fluid; the corked bottle and fluid receiving section, said stop, said cork and fluid receiving section, said cone shape, said reduced area section, said shoulder, and said cork-engaging member and fluids receiving section define a fluid flow path; the_fluid flow path extending from said open end to open end on said holder allowing fluid to flow into and through said holder operatively lowering fluid pressure of flowing fluid, creating a vacuum at said reduced area section drawing atmosphere to flow from outside of said holder through said air inlet and into said reduced area section to introduce and assimilate the flowing fluid with a second fluid; the corked bottle and fluid receiving section, said stop, said cork and fluid receiving section, said cone shape, said reduced area section, said shoulder, and said corkscrew and fluids receiving section define a cork-engaging member guide; and the air inlet coupling said fluid flow path to atmosphere.

2. The combined corked bottle opener and fluid aerator of claim 1 wherein said corked bottle and fluid receiving section operative to engage a corked bottle, align said corked bottle to said holder for cork extraction and receive a fluid during fluid aeration.

3. The combined corked bottle opener and fluid aerator of claim 1 wherein said stop provides stop means preventing said corked bottle from entering said cork and fluid receiving section and function as a bearing surface when the holder is rotated on the top of the corked bottle when removing the cork from the bottle.

4. The combined corked bottle opener and fluid aerator of claim 1 wherein said the corked bottle and fluid receiving section, the cork and fluid receiving section, and said cone shape cooperatively define a fluid reservoir and funnel.

5. The combined corked bottle opener and fluid aerator of claim 1 wherein said cone shape provides stop means for said cork when removing said cork from said cork-engaging member and funnel means to funnel fluid from said cork and fluid receiving section into said reduced area section.

6. The combined corked bottle opener and fluid aerator of claim 1 wherein said reduced area section is threaded to engage said cork-engaging member and constrict fluid flow from said reservoir, increasing fluid speed and lowering fluid pressure and creating a vacuum.

7. The combined corked bottle opener and fluid aerator of claim 6 wherein said threaded comprising a helical section with a diameter and thread pitch to compliment and engage said cork-engaging member.

8. The combined corked bottle opener and fluid aerator of claim 1 wherein said shoulder and cork-engaging member and fluids receiving section cooperatively provide a cork-engaging member receiving section and alignment to the thread and as a fluid receiving section for the fluids as they continue to mix and assimilate from said reduced area section as said fluids decrease in velocity and said fluid pressure increases.

9. The combined corked bottle opener and fluid aerator of claim 1 wherein said holder provides guide means for cork-engaging member.

10. The combined corked bottle opener and fluid aerator of claim 1 wherein said holder defines a fluid flow path for fluid aeration.

11. The combined corked bottle opener and fluid aerator of claim 1 wherein said a corked bottle and fluid receiving section, said stop, said cork and fluid receiving section, said cone shape, said reduced area section, said shoulder, and said cork-engaging member and fluids receiving section define a cork-engaging member guide.

12. The combined corked bottle opener and fluid aerator of claim 1 wherein said air inlet defines a pathway from the fluid flow path flowing through said reduced area section to the exterior of said holder allowing atmosphere to flow from the exterior of said holder to the interior of said holder mixing and assimilating the first fluid with a second fluid.

13. The combined corked bottle opener and fluid aerator of claim 1 wherein said fluid flow path extending from said open end to open end on said holder allowing a fluid to flow into and through said holder operatively lowering fluid pressure of flowing fluid, creating a vacuum at said reduced area section drawing atmosphere to flow from outside of said holder through said air inlet and into said reduced area section to introduce and assimilate the flowing fluid with a second fluid.

14. The combined corked bottle opener and fluid aerator of claim 13 wherein said a fluid is a wine.

15. The combined corked bottle opener and fluid aerator of claim 13 wherein said second fluid is atmosphere.

16. The combined corked bottle opener and fluid aerator of claim 1 wherein said holder includes a plurality of air inlets coupled to said reduced area section.

17. The combined corked bottle opener and fluid aerator of claim 1 wherein said corked bottle opener provides means to open a corked bottle with a full hand grip on said corked bottle and said holder while removing the cork from a corked bottle.

18. The combined corked bottle opener and fluid aerator of claim 1 wherein said cork-engaging member configured with a handle attached to a helical corkscrew, handle providing abutment means to top of said holder and hand grip means for rotation.

* * * * *